US008286872B2

(12) United States Patent
Laupstad et al.

(10) Patent No.: US 8,286,872 B2
(45) Date of Patent: Oct. 16, 2012

(54) REMOTE WEAPON SYSTEM

(75) Inventors: Kjell M. Laupstad, Heggedal (NO); Rune Werner, Fagerstrand (NO); Eirik Malterud, Asker (NO); Leif O. Haugen, Kongsberg (NO)

(73) Assignee: Kongsberg Defence & Aerospace AS, Kongsberg (NO)

( * ) Notice: Subject to any disclaimer, the term of this patent is extended or adjusted under 35 U.S.C. 154(b) by 84 days.

(21) Appl. No.: 12/853,645

(22) Filed: Aug. 10, 2010

(65) Prior Publication Data

US 2012/0153021 A1 Jun. 21, 2012

Related U.S. Application Data

(63) Continuation-in-part of application No. 12/538,328, filed on Aug. 10, 2009.

(30) Foreign Application Priority Data

Aug. 17, 2009 (NO) ..... 20092847

(51) Int. Cl.
*B64D 1/04* (2006.01)
*F41F 5/00* (2006.01)

(52) U.S. Cl. ..... 235/404; 235/412; 89/1.11

(58) Field of Classification Search ..... 235/404, 235/411, 412; 8/1.11; 89/1.11
See application file for complete search history.

(56) References Cited

U.S. PATENT DOCUMENTS

| | | | | |
|---|---|---|---|---|
| 3,974,740 | A * | 8/1976 | Billottet et al. | 89/41.07 |
| 4,464,975 | A * | 8/1984 | Terry et al. | 89/41.13 |
| 5,279,229 | A * | 1/1994 | Bredy et al. | 102/425 |
| 5,497,705 | A | 3/1996 | Bredy et al. | |
| 5,682,006 | A | 10/1997 | Perry et al. | |
| 7,210,392 | B2 | 5/2007 | Greene et al. | |
| 7,637,195 | B2 * | 12/2009 | O'Dwyer | 89/1.11 |
| 2003/0051597 | A1 | 3/2003 | O'Dwyer | |
| 2004/0237762 | A1 * | 12/2004 | O'Dwyer | 89/1.11 |
| 2008/0148925 | A1 * | 6/2008 | O'Dwyer | 89/1.11 |
| 2009/0002677 | A1 | 1/2009 | Lindquist et al. | |

FOREIGN PATENT DOCUMENTS

| | | |
|---|---|---|
| AU | 2007204076 | 9/2007 |

* cited by examiner

*Primary Examiner* — Daniel Hess
(74) *Attorney, Agent, or Firm* — Young & Thompson

(57) ABSTRACT

A remote weapon system (10) includes: a fire control unit (12); and a mechanical support (14) to which a weapon (18) capable of firing airburst ammunition is mountable, the mechanical support being adapted to move the weapon in azimuth and elevation directions. The fire control unit is adapted to receive input parameters including at least one area parameter related to a geographical area to be covered by the airburst ammunition from the weapon. Further, the fire control unit is configured to automatically calculate a number of shots of the weapon as well as azimuth and elevation directions of the mechanical support for each shot based on the input parameters such that substantially the entire geographical area is covered by the airburst ammunition when the weapon is fired.

10 Claims, 5 Drawing Sheets

REMOTE WEAPON SYSTEM

FIELD OF THE INVENTION

The present invention relates to a remote weapon system, a fire control unit, an airburst control method, and a computer program product.

BACKGROUND OF THE INVENTION

An airburst or air burst is generally defined as the burst or detonation of a shell or bomb in the air instead of on contact with the ground or target.

An airburst or airburst ammunition may be delivered or fired by a weapon mounted to a remote weapon system or station (RWS). An RWS is generally a remotely controlled weapon station for light and medium calibre weapons which can be installed on any type of vehicle or other platforms (land or sea-based).

A prior art scenario for covering a specific grid or geographical area with airburst ammunition may involve an operator of the remote weapon station manually adjusting the remote weapon station in azimuth and elevation direction. The operator will fire the airburst ammunition, and try to cover the entire grid area. This may however be inaccurate, and the waste of ammunition may be significant.

SUMMARY OF THE INVENTION

It is an object of the present invention to at least partly overcome the above problems, and to provide an improved remote weapon system.

This object, and other objects that will be apparent from the following description, is achieved by the present invention as defined in the appended independent claims. Embodiments are set forth in the appended dependent claims.

According to an aspect of the present invention, there is provided a remote weapon system, comprising: a fire control unit; and a mechanical support to which a weapon capable of firing airburst ammunition is mountable, the mechanical support being adapted to move the weapon in azimuth and elevation directions, wherein the fire control unit is adapted to receive input parameters including at least one area parameter related to a geographical area to be covered by the airburst ammunition from said weapon, and the fire control unit is configured to automatically calculate a number of shots of the weapon and also azimuth and elevation directions of the mechanical support for each shot based on said input parameters such that substantially the entire geographical area is covered by the airburst ammunition when the weapon is fired.

By automatically calculating the number of shots and also azimuth and elevation directions for each shot, a specific area may be covered with airburst ammunition in a swift manner and with high precision. In addition, a minimum of ammunition will be used while covering the area.

The input parameters may further include ammunition type and/or at least one climatic parameter. The ammunition type is preferably associated with a predetermined footprint and time of flight for that particular type of ammunition. The at least one climatic parameter may include wind and/or temperature. Accounting for these input parameters may improve the accuracy of the above calculation.

In one embodiment of the present invention, the at least one area parameter defines said geographical area and comprises start angle in azimuth direction, stop angle in azimuth direction, minimum range, and maximum range. Start angle in azimuth direction, stop angle in azimuth direction, minimum range, and maximum range may for instance be manually entered by an operator.

Further, the at least one area parameter may initially only comprise the position of a detected (potential) target. The position may for instance be expressed as azimuth direction and range, or as GPS-coordinates. The position may be manually provided by an operator based on visual observation. Alternatively, the position may be provided by a (non-human) threat detection system, for instance a system adapted to detect incoming fire.

In one particular embodiment of the present invention, the fire control unit is configured to determine the geographical area based on a theoretical calculation of movement of the target starting from said position. The fire control unit may for instance be configured to increase the geographical area over time. Also, the input parameters may further include target speed, to more accurately and efficiently determine the geographical area. The target speed may for instance be divided into three levels: low (for walking/crawling target), medium (for running target), and high (for vehicle target). The target speed may be entered manually by an operator.

In one embodiment, the fire control unit is configured to automatically calculate the number of shots of the weapon by dividing the total geographical area with a footprint of the current airburst ammunition type.

In one embodiment, the fire control unit is configured to automatically calculate azimuth and elevation directions of the mechanical support for each shot by applying a predefined firing pattern over the geographical area, which predefined firing pattern indicates distance and azimuth direction for a number of shots (of the predefined firing pattern) falling within the geographical area. The predefined firing pattern may for instance be grid-shaped or spiral-shaped.

In one embodiment, said input parameters further include a height parameter representing a target altitude or a detonation height above the target, and the fire control unit is configured to automatically adjust the elevation direction(s) in accordance with this height parameter. For instance, if there is a certain distance to a target, and the operator of the system wants the grenade to detonate about 10 meters above the target, then the fire control unit sets a longer distance to the target (higher elevation angle of the weapon) to allow the grenade to detonate at the desired height.

According to another aspect of the present invention, there is provided a fire control unit for controlling a remote weapon station, wherein the fire control unit is adapted to: receive input parameters including at least one area parameter related to a geographical area to be covered by airburst ammunition from a weapon (of the remote weapon station) capable of moving in azimuth and elevation directions; and automatically calculate a number of shots and also azimuth and elevation directions for each shot of the weapon such that substantially the entire geographical area is covered by the airburst ammunition when said weapon is fired. This aspect may exhibit similar technical effects and features as the previously presented aspect of the invention.

According to yet another aspect of the present invention, there is provided an airburst control method, comprising: receiving input parameters including at least one area parameter related to a geographical area to be covered by airburst ammunition from a weapon capable of moving in azimuth and elevation directions; automatically calculating a number of shots and also azimuth and elevation directions for each shot of the weapon such that substantially the entire geographical area is covered by the airburst ammunition when said weapon is fired; and controlling the weapon accordingly, or indicating instructions for controlling the weapon accordingly. This aspect may exhibit similar technical effects and features as the previously presented aspects of the invention.

According to a further aspect of the present invention, there is provided a computer program product comprising instructions for causing a computer to perform the previously presented method when the product is executed on a computer.

BRIEF DESCRIPTION OF THE DRAWINGS

These and other aspects of the present invention will now be described in more detail, with reference to the appended drawings showing currently preferred embodiments of the invention.

DETAILED DESCRIPTION

Figure 1:
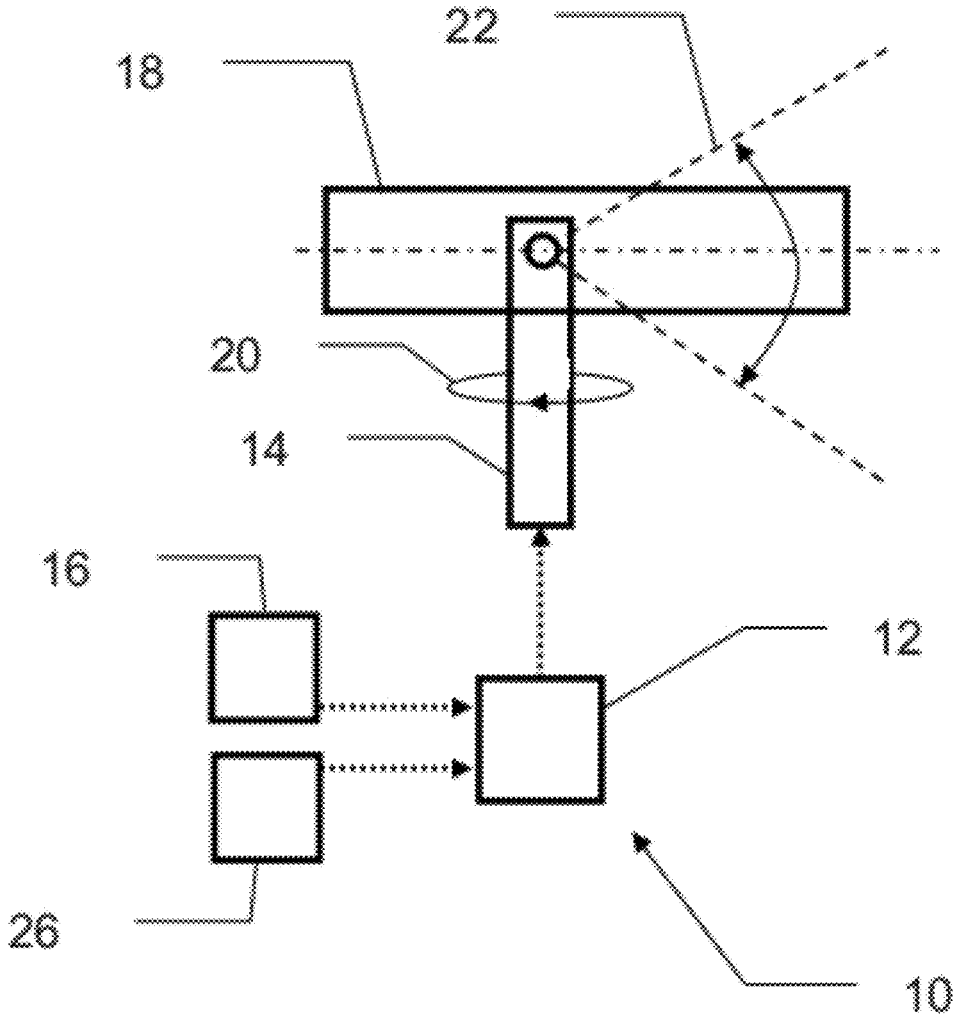
FIG. 1 is a block diagram illustrating a remote weapon system according to an embodiment of the present invention.

FIG. 1 is a block diagram illustrating a remote weapon system or station (RWS) 10 according to an embodiment of the present invention. The present RWS 10 will be described in the context of an automatic airburst retaliation system.

Basically, the RWS 10 comprises a fire control unit 12, a mechanical support 14, and an input means 16. Further, a weapon 18 is mounted to the mechanical support 14. The support 14 and weapon 18 are schematically shown in a side view in FIG. 1.

The mechanical support 14 is operably connected to the fire control unit 12. The mechanical support is adapted to move the weapon 18 is azimuth and elevation directions (indicated by 20 and 22, respectively) based on instructions from the fire control unit 12.

The input means 16 is also operably connected to the fire control unit 12. The input means 16 may for instance comprise a control grip through which an operator manually may provide input parameters to the fire control unit 12. Also, input parameters may be automatically provided to the fire control unit 12 from a non-human means. In the present embodiment, this means is a threat detection system 26. The system 26 may for instance be adapted to detect incoming fire and indicate the position of the shooter (incoming fire detection system) or the presence of a target aiming towards or locking on the RWS 10. An example of a suitable system 26 is the Boomerang system provided by BBN Technologies. Another system 26 that may be used in conjunction with the present invention is the PDCue system from AAI.

The weapon 18 is capable of firing airburst ammunition, preferably grenades. The weapon 18 may for instance be an automatic grenade launcher or grenade machine gun, such as the MK47 provided by General Dynamics.

The fire control unit 12 is basically configured to automatically calculate the number of shots to be fired by the weapon and also the weapon azimuth and elevation directions of the mechanical support 14 for each shot such that substantially a complete geographical area or grid area, or at least a large portion of that area, is covered by the airburst ammunition when the weapon 18 is fired. The calculation is based on the input parameters provided by the operator via the input means 16 and/or from the threat detection system 26. The input parameters include at least one area parameter related to said grid area. The fire control unit 12 may then automatically control the weapon and mechanical support in accordance with the calculated data. In this embodiment, the at least one area parameter is provided by the incoming fire detection system 26.

Also in this embodiment, the fire control unit 12 is configured to dynamically determine the grid area to be covered based on a theoretical calculation of movement of the target detected by the system 26. Typically, the grid area will increase over time. To more accurately and efficiently determine the geographical area, a target speed input parameter may be accounted for when performing said theoretical calculation of movement. The target speed may be entered manually by the operator based on visual inspection of the target by the operator.

An operation of the RWS 10 of FIG. 1 will now be described in more detail with reference to the flow chart of FIG. 2

First, the operator activates the RWS 10 in S1.

Figure 3:
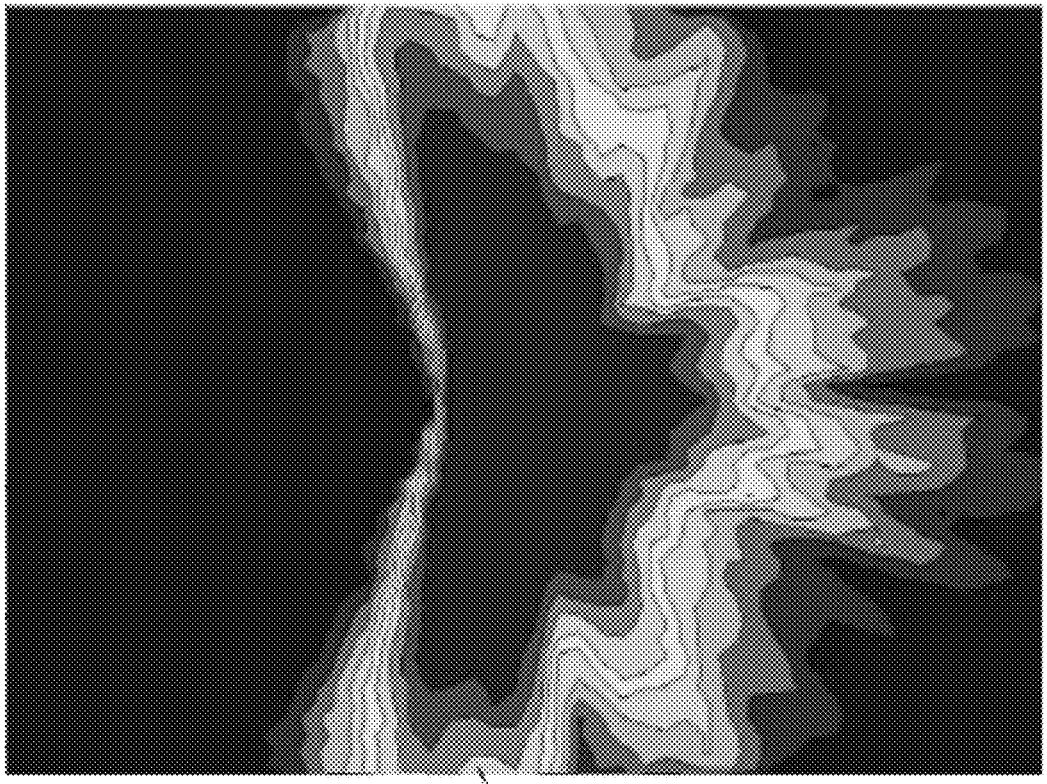
FIG. 3 is a top view illustrating an exemplary ammunition footprint.

In S2, the operator may define the type of airburst ammunition via the input means 16. Based on the type of airburst ammunition, the footprint and ballistic table giving the time of flight at different ranges for that particular ammunition are loaded in the fire control unit 12. An exemplary footprint 28 of a nose fused 40 mm HE warhead is illustrated in FIG. 3. Also, the operator may enter any climatic parameters, such as wind and/or temperature.

In S3, the incoming fire detection system 26 detects the position of a potential target firing a shot. The position is typically indicated as the azimuth direction and range to the target. The position of the target is received by the fire control unit 12, which automatically points the weapon 18 towards the detected target.

Following S3, the operator may optionally enter a target speed parameter via the input means 16 in S4. The entered target speed may be one of three levels: low for walking/crawling target, medium for running target, and high for vehicle target. The target speed may alternatively be entered in advance, i.e. before step S3.

In S5, the fire control unit 12 dynamically determines the grid area to be engaged based on a theoretical calculation of movement of the target starting from the position detected by the system 26. Also, the time elapsed since the target was detected as well as the optional target speed may be accounted for.

Figure 4A:
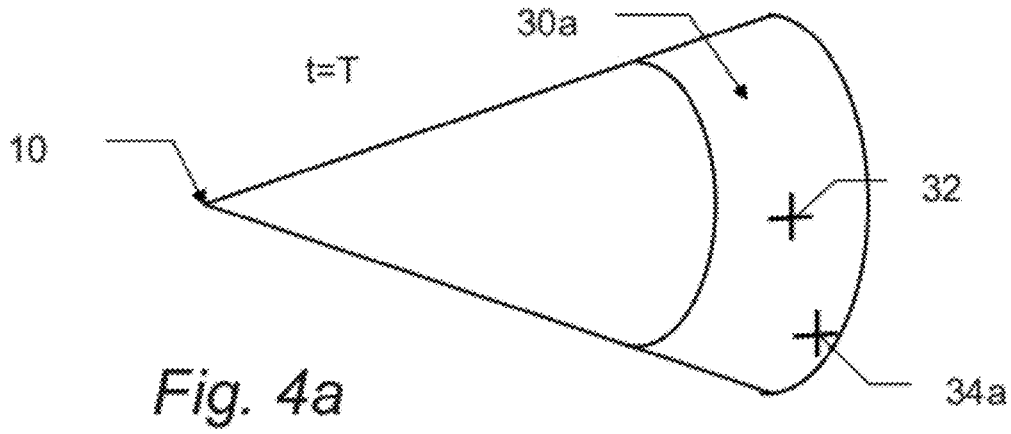
FIGS. 4*a*-4*b* are top views illustrating grid areas at different times.
Figure 4B:
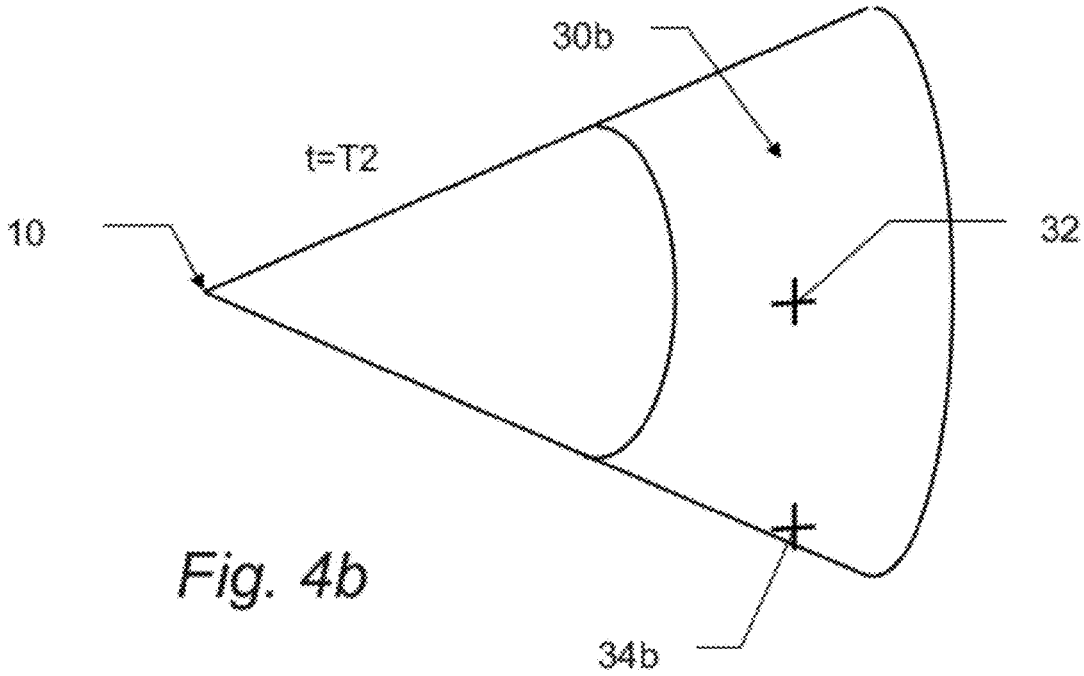

In an exemplary calculation in S5, the time elapsed since the target was detected in S3 equals 2 seconds, and the target speed is low=1 m/s. Further, the range or distance to the target is 500 meters, and the time of flight for the current type of airburst ammunition at 500 meters is 2.4 seconds. The theoretical distance covered by the target is then calculated by the fire control unit 12 as (2 seconds+2.4 seconds)*1 m/s=4.4 meter. Further, the theoretical area covered by the target (i.e. grid area to be covered with airburst ammunition) is $\pi*4.4^2 \approx 61\ m^2$. An exemplary area 30*a* at time t=T is illustrated in FIG. 4*a*. The detected target position is designated 32, and a possible actual target position is designated 34*a*. Further, an exemplary extended grid area 30*b* at a time t=T2, where T2>T, is shown in FIG. 4*b*. A possible target position at t=T2 is designated 34*b*.

Then, in S6 a number of shots to be fired by the weapon 18 is calculated by the fire control unit 12 based on the area determined in S5 and the footprint of the current ammunition.

With the above example, and a lethality footprint of the current ammunition of 10 $m^2$, the number of shots needed=61 $m^2$/10 $m^2$=7 shots. The RWS is so accurate that usually only a small overlap between the footprints of fired shots is necessary.

Figure 5:
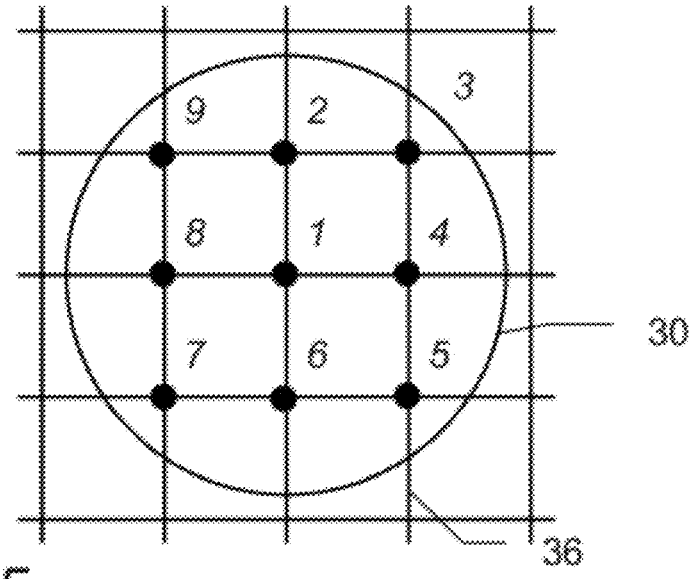
FIG. 5 illustrates an exemplary firing pattern according to an embodiment of the present invention.

Further in S6, the fire control unit 12 calculates the azimuth direction or angle and the elevation direction for each shot. This may be performed by applying a predefined firing distribution pattern over the geographical area. An exemplary grid-shaped firing pattern 36 is shown in FIG. 5 (top view). In FIG. 5, nine shots are required to cover the area 30, as defined by the intersections of the grid falling within the area 30. A firing sequence is indicated by numbers 1-9 in italic. Preferably, the first shot 1 is aimed at the specific position of the target detected by the incoming fire detection system. For each shot, the firing pattern indicates the distance and the azimuth direction or bearing. The azimuth direction or bearing of each shot may be directly used by the fire control unit 12, while the elevation of each shot may be calculated based on the indicated distance according to principles known per se. If the area 30 is increased, it is realised that more shots or intersections may fall within the area and hence more shots may be added to the firing sequence. Also, instead of a grid-shaped firing pattern, a spiral-shaped grip patter may be used, for example.

Hence, the output of S6 is a number of shots, azimuth direction of each shot, elevation direction of each shot, and an order in which the shots are to be fired (firing sequence).

Thereafter, in S7 the fire control unit 12 checks whether firing is allowed, e.g. if a fire trigger is pushed by the operator. If firing is not allowed in S7, the RWS 10 is put into idle mode in S10.

If firing is allowed in S7, the fire control unit adjusts the mechanical support 14 in accordance with the azimuth direction and elevation direction calculated in S6 for a particular shot, and the particular shot is subsequently fired (S8). Only a single shot is fired at a time.

In S9, the fire control unit adjusts the mechanical support 14 in accordance with the azimuth direction and elevation direction for the next shot in the firing sequence, and if firing is allowed in S7, the next shot is fired.

S8-S9 are repeated until firing no longer is enabled in S7, or until the complete area has been covered.

Preferably, the steps S5-S6 are continuously preformed until the first shot is fired in S8, at which point the final grid area and firing sequence are established. The weapon may have a firing rate of up to five shots per second, so a relatively large area may usually be covered in 2-3 seconds. During this relatively short time, there is usually no need to re-calculate the grid area and firing sequence. However, the theoretical grid area and firing sequence may be further updated also during the firing, and any additional shots due to increased grid area over time may be added to the firing sequence, to increase the probability of success in eliminating the target.

Figure 2:
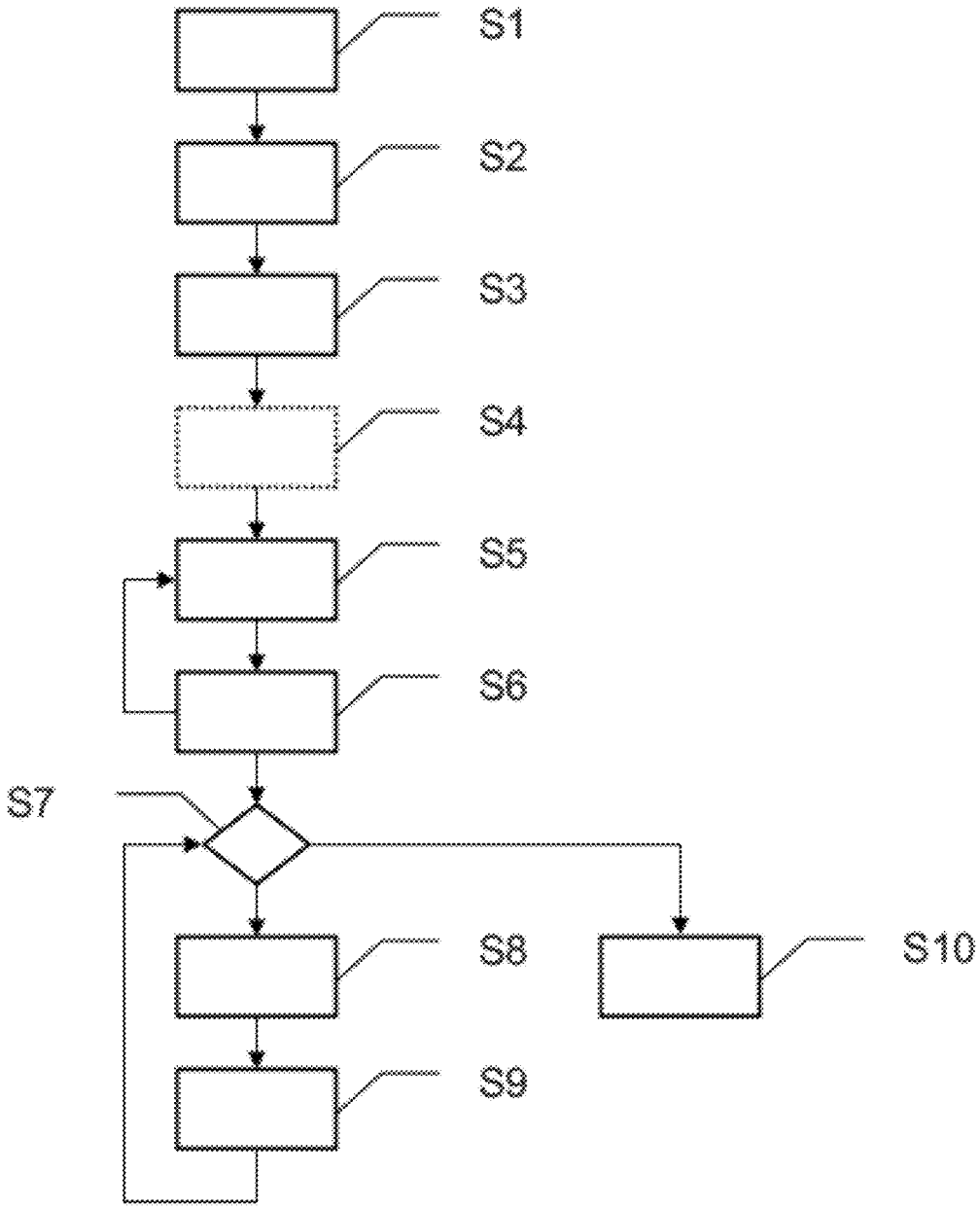
FIG. 2 is a flow chart illustrating an operation of the remote weapon system of FIG. 1.

In the embodiment described in relation to FIGS. 1-2, the target is automatically located, by means of the incoming fire detection system 26 in S3. Further, the grid area is dynamically determined, by the fire control unit 12 in S5. However, in other embodiments, the target may be manually located. Also, the grid area may be manually determined.

For instance, in one embodiment, the operator may manually enter a target grid area via the input means by inputting start angle in azimuth direction, stop angle in azimuth direction, minimum range, and maximum range. The operator may for instance move the weapon by means of the control grip to point at a start angle in azimuth direction, then move the weapon to point at a stop angle in azimuth direction, and finally define min and max range. After the area is defined, the fire control unit calculates the number of shots and also azimuth and elevation directions for each shot such that substantially the entire area is covered by the airburst ammunition when the weapon subsequently is fired, like in S6 above. Thus, in this embodiment, the threat detection system 26 as well as S3-S5 may be omitted. Instead, the target is manually located, and the grid area is manually determined.

In another embodiment, the operator manually enters a target position via the input means. The operator may for instance move the weapon by means of the control grip to point at a particular position. Then, the operation may continue as from S5 (or S4) in FIG. 2. Thus, the target is manually located, but the grid area is dynamically determined. Also, the threat detection system 26 may be omitted.

In yet another embodiment, a target position is automatically retrieved by the incoming fire detection system, and the weapon may be automatically directed accordingly. Then, starting from this position, the operator may manually enter a target grid area by moving the weapon to point at a start angle in azimuth direction, moving the weapon to point at a stop angle in azimuth direction, and finally defining min and max range. After the area is defined, the fire control unit calculates the number of shots as well as azimuth and elevation directions for each shot such that substantially the entire area is covered by the airburst ammunition when the weapon subsequently is fired, like in S6 above. Thus, in this embodiment, the target is automatically located, but the grid area is manually determined.

Further, a hit probability parameter may be implemented as an operator controllable parameter. The theoretical hit probability (assuming to overlap between the fired grenades) is (N*a)/A, where N is the number of shots, a is lethality footprint (from airburst grenade), and A is the total area to be covered. Adjusting the hit probability parameter will have an influence on the number of airburst grenades fired, and the fractional damage can be expressed as:

Disturbing fire: hit probability less than 10%

Suppressing fire: hit probability more than 50%

Neutralizing fire: hit probability more than 90%

Also, a height parameter may be implemented in the fire control unit as an operator controllable parameter. The height parameter may represent a target altitude or a detonation height above the target. Depending on the height of the detonation, the geometrical area that the airburst grenade covers will change. For instance, if the grenade is detonated at a higher altitude above the target, then the fragments of the grenade will not be that damaging. This also means that a larger area on the ground will be covered, an fewer grenades may be used to cover a specific area (and the opposite).

To this end, the fire control unit of the present invention may be configured to automatically adjust the elevation direction(s) in accordance with this height parameter as settable by the operator. For instance, if the distance to the target is 600 meters and the grenade should detonate about ten meters above the target, then the distance or ballistics is set to e.g. 630 meters to get a detonation in the air when the grenade passes 600 meters, and the fire control unit will set a higher elevation direction or angle for the weapon to allow detonation 10 meters above the ground when the grenade passes 600 meters. The detonation time or detonation height above ground of the grenade is set accordingly.

Figure 6:
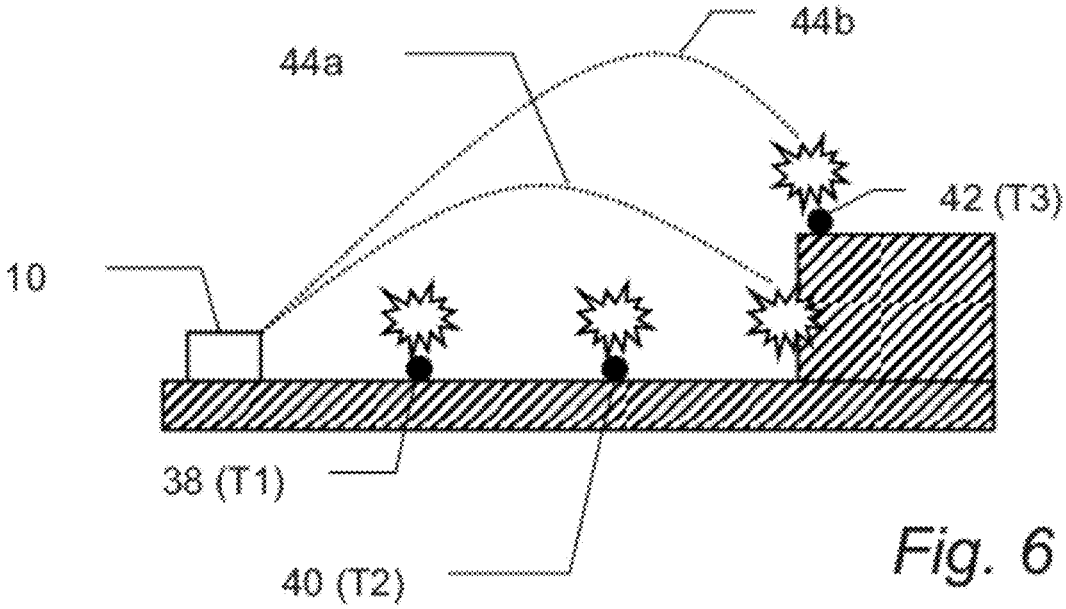
FIG. 6 is a side view illustrating adjustment of a height parameter.

Further, if the target to be engaged by the present RWS is moving to a higher altitude or a lower altitude during the time of engagement, the height parameter may be adjusted to account for this. In FIG. 6, point 38 represents the target at time T, point 40 represents the target at time T2, and point 42 represents the target at time T3. Points 38 and 40 are in level, but point 42 is 50 meters higher up. By adjusting the elevation of the weapon with respect to the distance between the RWS 10 and the target, points 38 and 40 may be engaged all right, but a grenade fired against point 42 will miss, see trajectory 44*a*. On the other hand, by adjusting the elevation of the weapon in accordance with the altitude of point 42—in this case increasing the elevation angle with respect to the increase height of 50 meters, point 42 may be engaged successfully, see trajectory 44*b*.

The height parameter may also be associated with the above mentioned hit probability: by increasing the height of detonation above the target, the hit probability will be reduced, but a larger geographical area may be covered by each grenade.

The person skilled in the art realized that the present invention by no means is limited to the preferred embodiments described above. On the contrary, many modifications and variations are possible within the scope of the appended claims.

The invention claimed is:

1. A remote weapon system, comprising:

a fire control unit; and a mechanical support to which a weapon capable of firing airburst ammunition is mountable, the mechanical support being adapted to move the weapon in azimuth and elevation directions, wherein the fire control unit comprises, input means for receiving input parameters including at least one parameter related to a position of a detected target, first calculation means for continuously calculating a dynamically variable geographical area to be covered by the airburst ammunition from said weapon based on a speed of the detected target and calculation of movement of the detected target starting from the position of the detected target, and second calculation means for automatically calculating a number of shots to be fired by the weapon and azimuth and elevation directions of the mechanical support for each of the shots to be fired based on said input parameters such that substantially an entire final geographical area is covered by the airburst ammunition, where the final geographical area is the area calculated by said first calculation means when the weapon is fired.

2. A remote weapon system according to claim 1, wherein said input parameters further include ammunition type and/or at least one climatic parameter.

3. A remote weapon system according to claim 1, wherein said at least one parameter defines said geographical area and comprises start angle in azimuth direction, stop angle in azimuth direction, minimum range, and maximum range.

4. A remote weapon system according to claim 1, wherein said position of the detected target is provided by a threat detection system.

5. A remote weapon system according to claim 1, wherein the fire control unit is configured to automatically calculate the number of shots of the weapon by dividing the total geographical area with a footprint of the current airburst ammunition type.

6. A remote weapon system according to claim 1, wherein the fire control unit is configured to automatically calculate azimuth and elevation directions of the mechanical support for each shot by applying a predefined firing pattern over the geographical area, which predefined firing pattern indicates distance and azimuth direction for a number of shots of the predefined firing pattern falling within the geographical area.

7. A remote weapon system according to claim 1, wherein said input parameters further include a height parameter representing a target altitude or a detonation height above the target, and wherein the fire control unit is configured to automatically adjust the elevation direction(s) in accordance with this height parameter.

8. A fire control unit for controlling a remote weapon station, wherein the fire control unit comprises:

input means for receiving input parameters including at least one parameter related to a position of a detected target;

first calculation means for continuously calculating a dynamically variable geographical area to be covered by the airburst ammunition from said weapon based on a speed of the detected target and calculation of movement of the detected target starting from the position of the detected target; and second calculation means for automatically calculating a number of shots to be fired by the weapon and azimuth and elevation directions for each of the shots to be fired based on said input parameters such that substantially an entire final geographical area is covered by the airburst ammunition, where the final geographical area is the area calculated by said first calculation means when the weapon is fired.

9. An airburst control method, comprising:

receiving input parameters including at least one parameter related to a position of a detected target;

continuously calculating a dynamically variable geographical area to be covered by the airburst ammunition from said weapon based on a speed of the detected target and calculation of movement of the detected target starting from the position of the detected target; and automatically calculating a number of shots to be fired by the weapon and azimuth and elevation directions for each of the shots to be fired based on said input parameters such that substantially an entire final geographical area is covered by the airburst ammunition, where the final geographical area is the area calculated by said first calculation means when the weapon is fired.

10. A non-transient computer storage medium storing a computer program product comprising instructions for causing a computer to perform the method of claim 9 when the product is executed on the computer.

* * * * *